US006074496A

United States Patent [19]

Yarita et al.

[11] Patent Number: 6,074,496

[45] Date of Patent: Jun. 13, 2000

[54] HIGH-STRENGTH OIL-TEMPERED STEEL WIRE WITH EXCELLENT SPRING FABRICATION PROPERTY AND METHOD FOR PRODUCING THE SAME

[75] Inventors: Hiroshi Yarita; Shouichi Suzuki, both of Chiba; Taisuke Nishimura; Takashi Otowa, both of Saitama, all of Japan

[73] Assignees: Suzuki Metal Industry Co., Ltd.; Honda Giken Kogyo Kabushiki Kaisha, both of Tokyo, Japan

[21] Appl. No.: 09/038,837

[22] Filed: Mar. 12, 1998

[30] Foreign Application Priority Data

Mar. 12, 1997 [JP] Japan ..... 9-057212

[51] Int. Cl.[7] ..... C22C 38/18; C21D 9/52

[52] U.S. Cl. ..... 148/333; 148/334; 148/335; 148/336; 148/580; 148/627; 148/908

[58] Field of Search ..... 148/580, 627, 148/334, 333, 335, 336, 908

[56] References Cited

U.S. PATENT DOCUMENTS 5,368,656 11/1994 Heitmann et al. ..... 148/580
5,415,711 5/1995 Takagi et al. ..... 148/580

*Primary Examiner*—Deborah Yee

*Attorney, Agent, or Firm*—Wenderoth, Lind & Ponack, L.L.P.

[57] ABSTRACT

A high-strength oil-tempered steel wire with excellent spring fabrication property that is made of spring low-alloy steel, having a decarburized layer of reduced hardness extending to a depth of not greater than 200 $\mu$m from the wire surface, a wire surface hardness in the range from an Hv (Vickers hardness) of 420 to an Hv of 50 below the Hv of the wire interior, and an Hv at the interior of the wire beyond the depth of the decarburized layer of not less than 550. The spring low-alloy steel can preferably comprise, in weight percent, 0.45–0.80% C, 1.2–2.5% Si, 0.5–1.5% Mn, 0.5–2.0% Cr and the balance of Fe and unavoidable impurities. The method for producing the foregoing steel wire comprises the steps of continuously passing and heating a starting material low-alloy steel wire fed through a furnace body through-pipe of a continuous heating furnace for oil tempering, decarburizing the low-alloy steel wire under regulation of a dew point of a decarburizing atmosphere in the pipe by introducing into the pipe from its inlet side or a desired intermediate point thereof hydrogen gas or a mixed gas of hydrogen gas and an inert gas and, to form steam by reaction therewith, oxygen gas or an oxygen-containing gas and controlling the amount of oxygen gas or oxygen-containing gas introduced, and thereafter quenching and annealing the low-alloy steel wire.

9 Claims, 6 Drawing Sheets

HIGH-STRENGTH OIL-TEMPERED STEEL WIRE WITH EXCELLENT SPRING FABRICATION PROPERTY AND METHOD FOR PRODUCING THE SAME

BACKGROUND OF THE INVENTION

1. Field of the Invention

This invention relates to high-strength oil-tempered steel wire with excellent spring fabrication property, high fatigue strength and low setting property that is suitable for use in vehicle internal combustion engines, suspensions systems and the like and to a method for producing the same.

2. Description of the Prior Art

Springs used in the internal combustion engines, suspension systems etc. of vehicles and the like are being reduced in size in response to the trend toward higher horse-power. This has lead to the development of more sophisticated spring materials in recent years as well as to the development of spring materials added with Mo and/or V to improve temper softening resistance.

While these spring materials improve spring fatigue strength, they make spring fabrication difficult. Even when minute surface defects that do not become fatigue starting points during use are present, they may cause breakage during spring fabrication, which makes it difficult to produce springs of uniform quality.

SUMMARY OF THE INVENTION

This invention was accomplished in light of the foregoing technical problems and has an object to provide high-strength oil-tempered steel wire with excellent spring fabrication property that improves spring fabricability to enable production of springs of uniform quality and exhibits high fatigue strength and high setting resistance. Another object of the invention is to provide a method for producing the high-strength oil-tempered steel wire with excellent spying fabrication property.

The inventors made studies toward overcoming the problems of the prior art. Through their research they discovered that the spring fabrication property of high-strength oil-tempered steel wire can be improved by regulating the dew point in a continuous heating furnace for producing the oil-tempered steel wire, subjecting low-alloy steel wire as a starting material to a combined oil-tempering and decarburizing treatment to obtain oil-tempered steel wire whose surface layer is reduced in hardness by formation of a decarburized layer to a prescribed depth, whose surface hardness is restricted to a prescribed range and whose hardness at an interior portion beyond the depth of the decarburized layer is restricted to a prescribed range. When patenting is conducted in a step prior to the oil-tempering, the decarburization can be conducted in the patenting step.

Through further research based on this discovery, it was found that, more specifically, high-strength oil-tempered steel wire with outstanding spring fabrication property is obtained when the oil-tempered steel wire has a decarburized layer of reduced hardness extending to a depth of not greater than 200 $\mu$m from the wire surface, a wire surface hardness in the range from an Hv (Vickers hardness) of 420 to an Hv of 50 below the Hv of the wire interior, and an Hv at the interior of the wire beyond the depth of the decarburized layer of not less than 550.

In accordance with this invention, high-strength oil-tempered steel wire can be imparted with stable spring fabrication property by providing a decarburized layer of reduced hardness extending to a depth of not greater than 200 $\mu$m from the wire surface and reducing the surface hardness to between an Hv of 420 and an Hv of 50 below the Hv of the wire interior, thereby lowering the fatigue notch sensitivity.

The surface hardness range is selected in light of the ratio of mean coil diameter to wire diameter (D/d) in spring fabrication.

Although reducing the surface hardness of a spring ordinarily lowers the spring's fatigue strength, the oil-tempered steel wire whose surface layer hardness has been reduced in accordance with this invention recovers or more than recover its surface hardness upon nitriding and/or hard shot peening treatment after spring fabrication. This enables production of high-strength springs with high fatigue strength and excellent setting resistance property.

The inventors further made studies regarding control of the heating furnace atmosphere for enabling stable production of the high-strength oil-tempered steel wire with excellent spring fabrication property according to the invention.

In closed furnaces, atmosphere control is a common practice, for example when carrying out nitriding and carburizing treatments. However, in the case of the continuous heating furnace (a heating furnace that effects in-line quenching and tempering of continuously fed steel wire) used to produce the oil-tempered steel wire of this invention, complete blocking of atmospheric air inflow through the inlet and outlet of the heating furnace is hard to achieve. Stable control of the atmosphere inside the furnace is therefore difficult.

Research was therefore pursued regarding a method for controlling the internal atmosphere of the continuous heating furnace during continuous passing and heating of a starting material low-alloy steel wire fed through the furnace body through-pipe. It was discovered that the dew point of the atmosphere in the pipe can be regulated for decarburizing the low-alloy steel wire by introducing into the pipe from its inlet side or a desired intermediate point thereof hydrogen gas or a mixed gas of hydrogen gas and an inert gas and, to form steam by reaction therewith, oxygen gas or an oxygen-containing gas, and controlling the amount of oxygen gas or oxygen-containing gas introduced. It was further ascertained that a stable decarburizing atmosphere can be secured when an inert gas such as Ar gas or nitrogen gas is introduced into the pipe from a point more toward the upstream side of the furnace than the point of the pipe where the hydrogen gas or the mixed gas of hydrogen gas and inert gas and the oxygen gas or oxygen-containing gas are introduced, so as to continuously push the steam atmosphere generated in the pipe toward the downstream side of the heating furnace. It was additionally learned that the hardness of the low-alloy steel wire surface can be regulated by changing the point of the pipe where the hydrogen gas or the mixed gas of hydrogen gas and inert gas and the oxygen gas or oxygen-containing gas are introduced, so as to change the duration of the exposure of the low-alloy steel wire under treatment to the decarburizing atmosphere.

This invention was accomplished based on these various discoveries. Its essential features are set out below.

One aspect of the invention provides a high-strength oil-tempered steel wire with excellent spring fabrication properly that is made of spring low-alloy steel, has a decarburized layer of reduced hardness extending to a depth of not greater than 200 $\mu$m from the wire surface, has a wire surface hardness in the range from an Hv (Vickers hardness) of 420 to an Hv of 50 below the Hv of the wire interior, and has an Hv at the interior of the wire beyond the depth of the decarburized layer of not less than 550.

The spring low-alloy steel can preferably comprise, in weight percent, 0.45–0.80% C, 1.2–2.5% Si, 0.5–1.5% Mn, 0.5–2.0% Cr and the balance of Fe and unavoidable impurities.

The spring low-alloy steel can preferably further comprise, in weight percent, one or more of 0.1–0.7% Mo, 0.2–2.0% Ni, 0.05–0.60% V and 0.01–0.20% Nb.

Another aspect of the invention provides a method for producing any of the foregoing high-strength oil-tempered steel wires with excellent spring fabrication property comprising the steps of continuously passing and heating a starting material low-alloy steel wire fed through a furnace body through-pipe of a continuous heating furnace for oil tempering, decarburizing the low-alloy steel wire under regulation of a dew point of a decarburizing atmosphere in the pipe by introducing into the pipe from its inlet side or a desired intermediate point thereof hydrogen gas or a mixed gas of hydrogen gas and an inert gas and, to form steam by reaction therewith, oxygen gas or an oxygen-containing gas and controlling the amount of oxygen gas or oxygen-containing gas introduced, and thereafter quenching and annealing the low-alloy steel wire.

An inert gas is preferably further introduced into the pipe from a point more toward the upstream side of the furnace than the point of the pipe where the hydrogen gas or the mixed gas of hydrogen gas and inert gas and the oxygen gas or oxygen-containing gas are introduced, thereby stabilizing the decarburizing atmosphere by continuously pushing the steam atmosphere generated in the pipe toward the downstream side of the heating furnace.

Another aspect of the invention provides a method for producing any of the foregoing high-strength oil-tempered steel wires with excellent spring fabrication property comprising the steps of continuously passing and heating a starting material low-alloy steel wire fed though a furnace body through-pipe of a continuous heating furnace for oil tempering, decarburizing the low-alloy steel wire under regulation of a dew point of a decarburizing atmosphere in the pipe by introducing into the pipe from its inlet side or a desired intermediate point thereof hydrogen gas or a mixed gas of hydrogen gas and an inert gas and, to form steam by reaction therewith, oxygen gas or an oxygen-containing gas, introducing an inert gas into the pipe from a point more toward the upstream side of the furnace than the point of the pipe where said gases are introduced, and controlling the amount of inert gas introduced, and thereafter quenching and annealing the low-alloy steel wire.

The hardness of the low-alloy steel wire surface can be preferably regulated by changing the point of the pipe where the hydrogen gas or the mixed gas of hydrogen gas and inert gas and the oxygen gas or oxygen-containing gas are introduced, so as to change the duration of the exposure of the low-alloy steel wire under treatment to the decarburizing atmosphere.

The production methods constituted in the foregoing manner according to the invention enable manufacture of high-strength oil-tempered steel wire that has a uniform decarburized layer and, as such, reduces occurrence of breakage during spring fabrication, even when minute surface defects that do not become a problem during spring operation are present, thus enabling fabrication of springs of uniform quality.

Oil-tempered steel wires to which the invention applies are not particularly limited by chemical composition and encompass such oil-tempered steel wires as the chromium-vanadium steel oil-tempered steel wire for valve springs, silicon-chromium steel oil-tempered steel wire for valve springs and silicon-manganese steel oil-tempered steel wire for springs standardized under JIS G 3565, 3566 and 3567. The advantageous effects of the invention are, however, particularly pronounced when the invention is applied to the low-alloy steel wires of the compositions set out above. Application of the invention is, however, in no way limited to the specific low-alloy steel materials mentioned.

The above and other features of the present invention will become apparent from the following description made with reference to the drawings.

DETAILED DESCRIPTION OF THE PREFERRED EMBODIMENT

Figure 1:
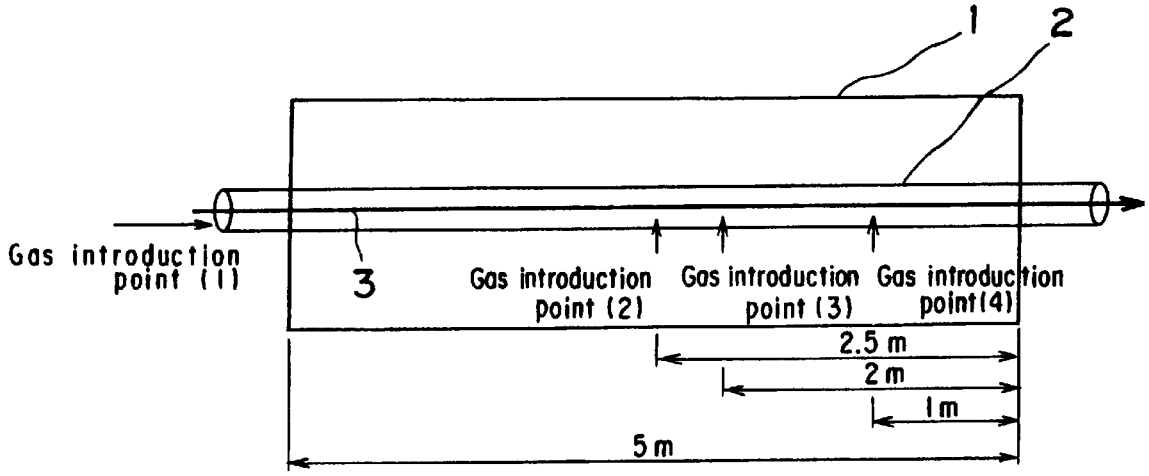
FIG. 1 is a schematic diagram of a continuous heating furnace for oil tempering used to produce the oil-tempered steel wire of this invention.

The low-alloy steels exemplified by this invention have chemical compositions of, in weight percent, 0.45–0.80% C, 1.2–2.5% Si, 0.5–1.5% Mn, 0.5–2.0% Cr and, as required, one or more of 0.1–0.7% Mo, 0.2–2.0% Ni, 0.05–0.60% V and 0.01–0.20% Nb, the balance being Fe and unavoidable impurities.

The reasons for the restrictions on the chemical composition of the low-alloy steel are as follows:

C: Although carbon is an element that effectively increases the steel strength, it does not provide the desired strength at a content below 0.45% and produces little additional strength enhancement when added to more than 0.80%. The range of C content is therefore specified as 0.45–0.80%.

Si: Silicon enters solid solution in ferrite. By this it increases the strength of the steel and delays tempering to their heighten temper softening resistance. However, since it has no effect at a content below 1.2% and provides no additional effect at a content above 2.5%, its content range is specified as 1.2–2.5%.

Mn: Although manganese is an element that effectively enhances quenching property, it has little effect at a content below 0.5% and produces no additional effect when added to more than 1.5%. The range of Mn content is therefore specified as 0.5–1.5%.

Cr: Although chromium is an element that effectively enhances quenching properly, it has little effect at a content below 0.5% and lowers strength by carbide formation at a content of more than 2.0%. The range of Cr content is therefore specified as 0.5–2.0%.

Mo: Molybdenum effectively enhances temper softening resistance and imparts strength and toughness. However, its effect does not appear at a content below 0.1% and saturates at a content above 0.7%. Since it also degrades toughness by carbide formation at a content above 0.7%, the range of Mo content is specified as 0.1–0.7%.

Ni: Although nickel is an element that effectively enhances toughness, it has little effect at a content below 0.2% and produces no additional effect when added to more than 2.0%. The range of Ni content is therefore specified as 0.2–2.0%.

V: Although vanadium is an element that effectively enhances crystal grain refinement and improves strength by precipitation of vanadium carbide, it has no effect at a content below 0.05% and produces no additional effect when added to more than 0.60%. The range of V content is therefore specified as 0.05–0.60%.

Nb: Although, like vanadium, niobium is also an element that effectively enhances crystal grain refinement, it has little effect at a content below 0.01% and degrades toughness by carbide formation when added to more than 0.20%. The range of Nb content is therefore specified as 0.01–0.20%.

EXAMPLES

The invention will now be explained with reference to specific examples.

Table 1 shows the chemical compositions of the test materials (low-alloy steels) used in the examples.

TABLE 1

| Test | (wt %) | | | | | | | | |
|---|---|---|---|---|---|---|---|---|---|
| Material | C | Si | Mn | Cr | Mo | Ni | V | Nb | Fe |
| No. 1 | 0.66 | 1.50 | 0.75 | 1.02 | — | — | — | — | Balance |
| No. 2 | 0.73 | 2.01 | 0.75 | 1.02 | 0.22 | — | 0.365 | 0.02 | Balance |
| No. 3 | 0.75 | 2.01 | 0.75 | 1.02 | 0.22 | 1.0 | 0.365 | 0.02 | Balance |

FIG. 1 is a schematic diagram showing a continuous heating furnace for oil tempering and the locations of gas introduction points. A 5-meter-long electric furnace was used as the continuous heating furnace.

In FIG. 1, reference numeral 1 designates the electric furnace, 2 a furnace boy through-pipe (the oil-tempered steel wire treatment pipe) and 3 a low-alloy steel wire under treatment The numerals (1) to (4) indicate gas introduction points.

An oil tempering means installed on the outlet side of the electric furnace 1 is omitted from the drawing.

Example 1

The low-alloy steel wire material shown as Test Material No. 1 in Table 1 was drawn to a wire diameter of 3.4 mm and the drawn wire was oil-tempered using the continuous heating furnace 1 to obtain oil-tempered steel wires as Comparative Material A and Comparative Material B. Table 2 shows the decarburizing atmosphere conditions and the oil-tempered steel wire property values for these comparative materials.

TABLE 2

Decarburizing atmosphere conditions and oil-tempered steel wire properties

| | Comparative Material A | Comparative Material B | Invention Material C |
|---|---|---|---|
| Test material | No. 1 | No. 1 | No. 2 |
| Inert gas | None | None | Ar |
| Inert gas feed rate (l/min) | — | — | 6 |
| Inert gas introduction point | — | — | (1) |
| Decarburizing gas | Air | $H_2 + N_2$ + Air | $H_2 + N_2$ + Air |
| $H_2 + N_2$ feed rate (l/min) | — | 2 | 2 |
| Air feed rate (l/min) | 4 | 0.25 | 0.25 |
| Decarburizing gas introduction point | (1) | (1) | (2) |
| Dew point (° C.) | +10 | +8 | +10 |
| Oil-tempered steel wire surface hardness (Hv) | 590 | Max 618 Min 540 | 540 |
| Oil-tempered steel wire internal hardness (Hv) | 625 | 625 | 625 |
| Difference between internal hardness and surface hardness of oil-tempered steel wire (Hv) | 35 | Max 7 Min 85 | 85 |
| Tensile strength (kgf/mm$^2$) | 230 | 231 | 231 |
| Reduction of area (%) | 45 | | 43 |
| Amount of residual austenite (%) | 7 | 7 | 7 |

Figure 2:
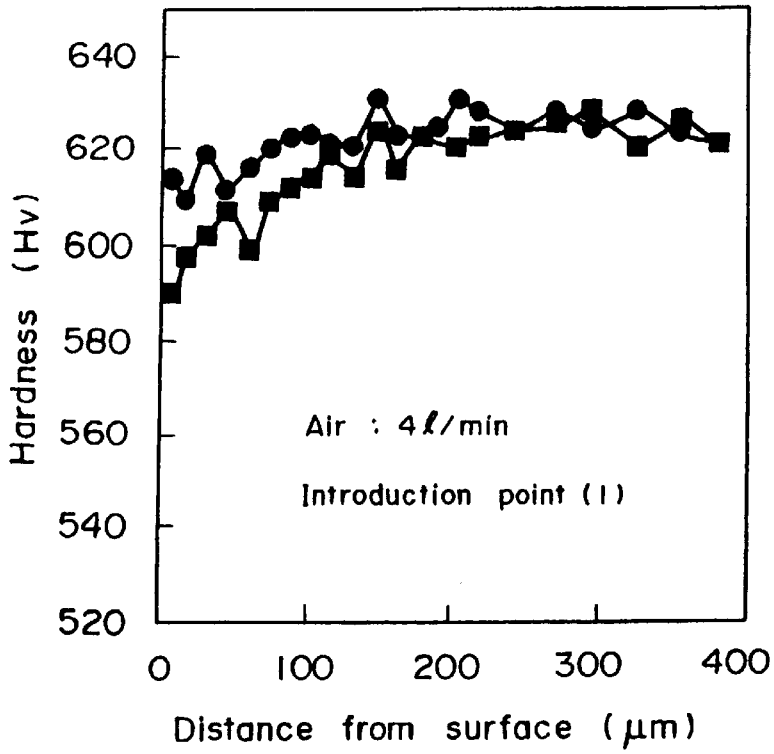
FIG. 2 is a graph showing the surface hardness distribution of a Comparative Material A.

FIG. 2 shows the surface hardness distribution of Comparative Material A. Comparative Material A is an oil-tempered steel wire obtained with only air introduced into the oil-tempered steel wire treatment pipe 2. Although decarburization occurred owing to the oxygen content of the introduced air, it was of low level and the decarburizing effect by this oxygen alone was insufficient. In addition, the oxygen produced a scale reaction and the surface scale peeled locally.

Figure 3:
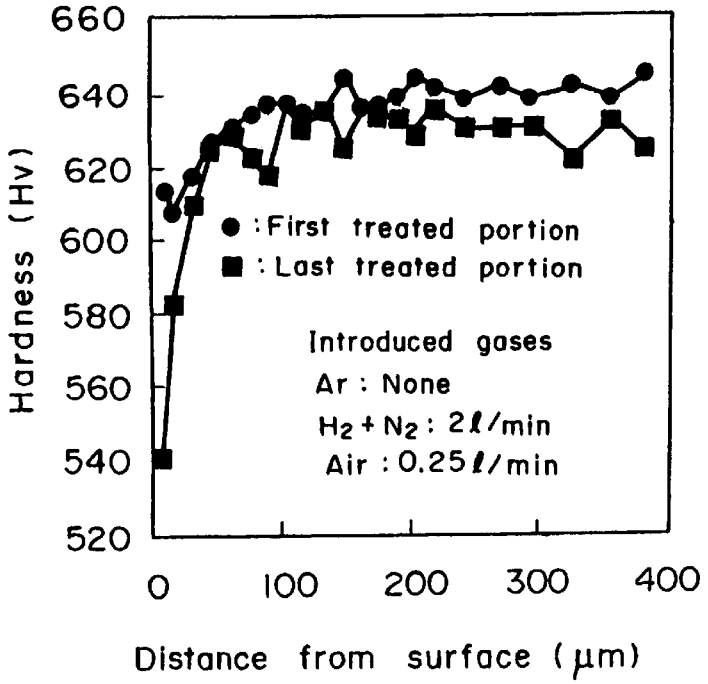
FIG. 3 is a graph showing the surface hardness distribution of a Comparative Material B.

FIG. 3 shows the surface hardness distribution of Comparative Material B. Comparative Material B is an oil-tempered steel wire obtained by effecting oil tempering treatment with an $H_2$+$N_2$ mixed gas and air introduced into the oil-tempered steel wire treatment pipe 2 from point (1). Although a decarburized layer was formed owing to a rise in the dew point of the heating atmosphere, the hardness in the lengthwise direction of the oil-tempered steel wire was not constant because the high-dew-point atmosphere stagnated in the pipe.

The low-alloy steel wire material shown as Test Material No. 2 in Table 1 was drawn to awire diameter of 3.4 mm and the drawn wire was oil-tempered using the continuous heating furnace 1 to obtain the oil-tempered steel wire shown as Invention Material C in Table 2.

Figure 4:
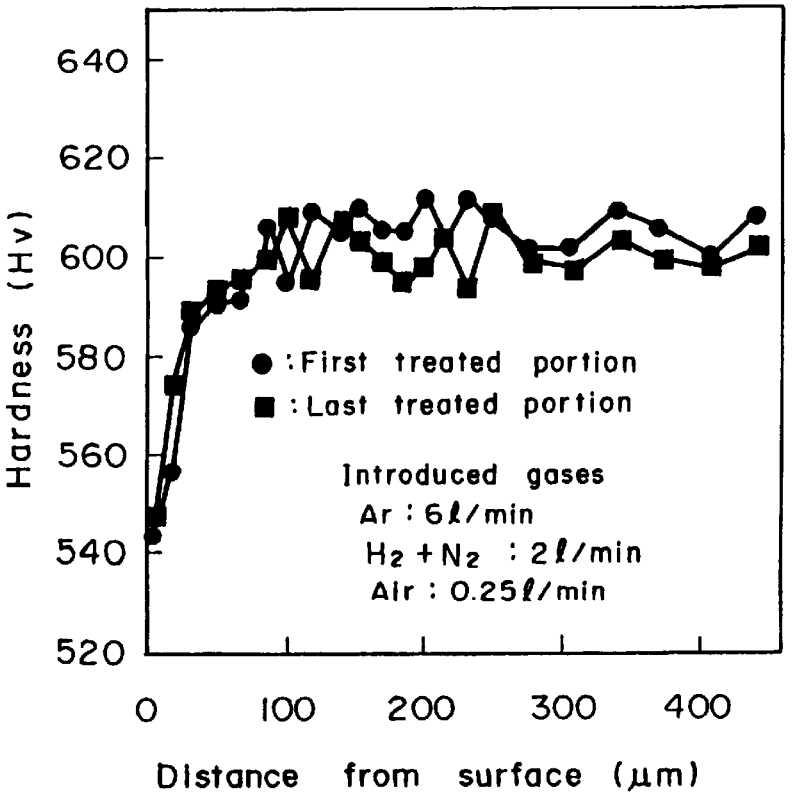
FIG. 4 is a graph showing the surface hardness distribution of an Invention Material C.

FIG. 4 shows the surface hardness distribution of Invention Material C. Invention Material C is an oil-tempered steel wire obtained by effecting oil tempering treatment with an $H_2$+$N_2$ mixed gas and air introduced into the oil-tempered steel wire treatment pipe 2 from point (2) and an inert gas (Ar gas) introduced from point (1) thereof.

In this oil tempering treatment, the introduction of the inert gas prevented stagnation of the furnace atmosphere by discharging it from the downstream side of the furnace. Since the degree of decarburization was therefore constant in the lengthwise direction of the oil-tempered steel wire, a uniform decarburized layer was formed. Moreover, compared with the case of introducing only oxygen, the decarburizing reaction proceeded more rapidly and no peeling of wire surface scale occurred.

These results show that when, in accordance with the invention, an $H_2$+$N_2$ mixed gas and air are introduced and an inert gas is further introduced from a point more toward the upstream side of the furnace than the point where the $H_2$+$N_2$ mixed gas is introduced, the furnace atmosphere is discharged from the downstream side of the continuous heating furnace, thereby preventing stagnation of the high-dew-point atmosphere in the furnace, enabling stable atmosphere control, and enabling the decarburization reaction to be effected uniformly and efficiently in the lengthwise direction of the oil-tempered steel wire.

Example 2

The low-alloy steel wire material shown as Test Material No. 2 in Table 1 was drawn to awire diameter of 3.4 mm and the drawn wire was oil-tempered under different decarburizing atmosphere conditions using the continuous heating furnace 1 to obtain oil-tempered steel wires as Invention Materials D, E, F, G and H.

Invention Materials D, E, F, G and H are oil-tempered steel wires obtained by effecting oil tempering treatment with an inert gas introduced into the oil-tempered steel wire treatment pipe 2 from point (1) and an $H_2$+$N_2$ mixed gas and air introduced from point (2) thereof.

Table 3 shows the decarburizing atmosphere conditions and the property values for Invention Materials D, E, F, G and H.

TABLE 3

Decarburizing atmosphere conditions and oil-tempered steel wire properties

| | Invention Material D | Invention Material E | Invention Material F | Invention Material G | Invention Material H |
|---|---|---|---|---|---|
| Test material | No. 2 | No. 2 | No. 2 | No. 2 | No. 2 |
| Inert gas | Ar | Ar | Ar | Ar | Ar |
| Inert gas feed rate (l/min) | 6 | 6 | 6 | 8 | 4 |
| Inert gas introduction point | (1) | (1) | (1) | (1) | (1) |
| Decarburizing gas | $H_2$ + $N_2$ + Air | $H_2$ + $N_2$ + Air | $H_2$ + $N_2$ + Air | $H_2$ + $N_2$ + Air | $H_2$ + $N_2$ + Air |
| $H_2$ + $N_2$ feed rate (l/min) | 2 | 2 | 2 | 2 | 2 |
| Air feed rate (l/min) | 0.58 | 0.32 | 0.25 | 0.32 | 0.32 |
| Decarburizing gas introduction point | (2) | (2) | (2) | (1) | (1) |
| Dew point (° C.) | +20 | +12 | +10 | +10 | +14 |
| Oil-tempered steel wire surface hardness (Hv) | 450 | 500 | 540 | 540 | 470 |
| Oil-tempered steel wire internal hardness (Hv) | 625 | 625 | 625 | 625 | 625 |
| Difference between internal hardness and surface hardness of oil-tempered steel wire (Hv) | 175 | 125 | 85 | 85 | 155 |
| Tensile strength (kgf/mm$^2$) | 233 | 233 | 230 | 230 | 230 |
| Reduction of area (%) | 43 | 40 | 45 | 45 | 43 |
| Amount of residual austenite (%) | 10 | 10 | 10 | 10 | 10 |

Figure 5:
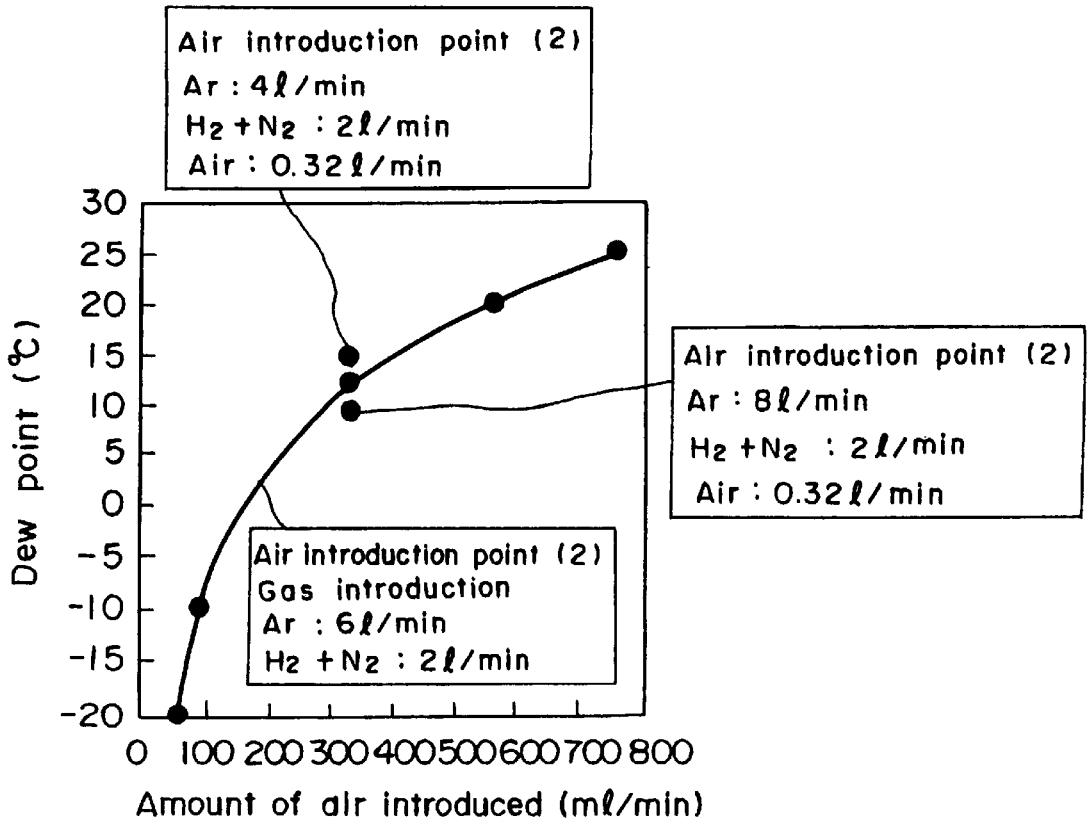
FIG. 5 is a graph showing how the dew point of the decarburizing atmosphere in the oil-tempered steel wire treatment pipe 2 of FIG. 1 varied as a function of the amount of air introduced into the pipe and as a function of the amount of inert gas introduced thereinto.
Figure 6:
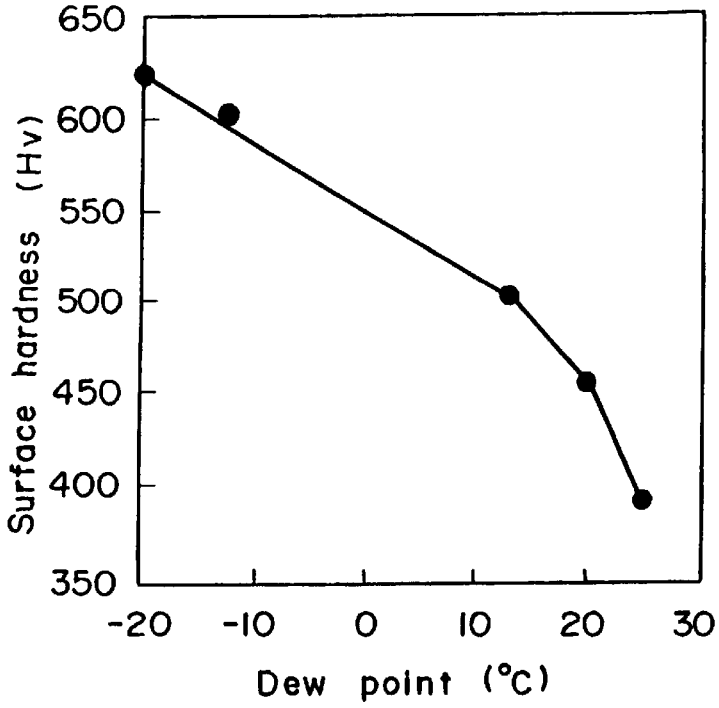
FIG. 6 is a graph showing how oil-tempered steel wire surface hardness varied as a function of the dew point of the decarburizing atmosphere.

FIG. 5 shows how the dew point varied as a function of the amount of introduced air and as a function of the amount of introduced inert gas. FIG. 6 shows how oil-tempered steel wire surface hardness varied as a function of the dew point.

The $H_2$ reacts with oxygen in the air to generate steam and raise the dew point. The rise in the dew point lowers the hardness of the oil-tempered steel wire surface and can be controlled by varying the amount of air introduced. It can also be controlled by varying the amount of inert gas introduced from the upstream side of the furnace.

In other words, the invention enables control of decarburization (surface hardness) by varying the amount of air introduced into the oil-tempered steel wire treatment pipe 2 and the amount of inert gas introduced from the upstream side of the furnace so as to control the dew point of the decarburizing atmosphere.

Example 3

The low-alloy steel wire material shown as Test Material No. 2 in Table 1 was drawn to a wire diameter of 3.4 mm and the drawn wire was oil-tempered under different decarburizing atmosphere conditions using the continuous heating furnace 1 to obtain oil-tempered steel wires as Invention Materials L and M and Comparative Materials I, J and K.

Table 4 shows the decarburizing atmosphere conditions and the property values for the materials.

TABLE 4

Decarburizing atmosphere conditions and oil-tempered steel wire properties

| | Comparative Material I | Comparative Material J | Comparative Material K | Invention Material L | Invention Material M |
|---|---|---|---|---|---|
| Test material | No. 2 | No. 2 | No. 2 | No. 2 | No. 2 |
| Inert gas | Ar | Ar | Ar | Ar | Ar |
| Inert gas feed rate (l/min) | 6 | 6 | 6 | 6 | 6 |
| Inert gas introduction point | (1) | (1) | (1) | (1) | (1) |
| Decarburizing gas | $H_2 + N_2$ + Air | $H_2 + N_2$ + Air | $H_2 + N_2$ + Air | $H_2 + N_2$ + Air | $H_2 + N_2$ + Air |
| $H_2 + N_2$ feed rate (l/min) | 2 | 2 | 2 | 2 | 2 |
| Air feed rate (l/min) | 0.05 | 0.10 | 0.75 | 0.21 | 0.58 |
| Decarburizing gas introduction point | (2) | (2) | (3) | (4) | (4) |
| Dew point (° C.) | −20 | −10 | +25 | +7 | +20 |
| Oil-tempered steel wire surface hardness (Hv) | 620 | 600 | 380 | 575 | 450 |
| Oil-tempered steel wire internal hardness (Hv) | 625 | 625 | 625 | 625 | 630 |
| Difference between internal hardness and surface hardness of oil-tempered steel wire (Hv) | 5 | 25 | 245 | 50 | 180 |
| Tensile strength (kgf/mm$^2$) | 233 | 233 | 232 | 230 | 233 |
| Reduction of area (%) | 41 | 43 | 45 | 44 | 40 |
| Amount of residual austenite (%) | 10 | 10 | 10 | 10 | 10 |

The spring fabrication properties of Invention Materials L and M and Comparative Materials I, J and K were evaluated by a coiling test. In spring fabrication of ordinary valve springs, the ratio of mean coil diameter to wire diameter (D/d) is around 5. In this Example, fabrication was conducted under the more severe conditions of D/d=4 and D/d=2 (self-diameter coiling).

Figure 7:
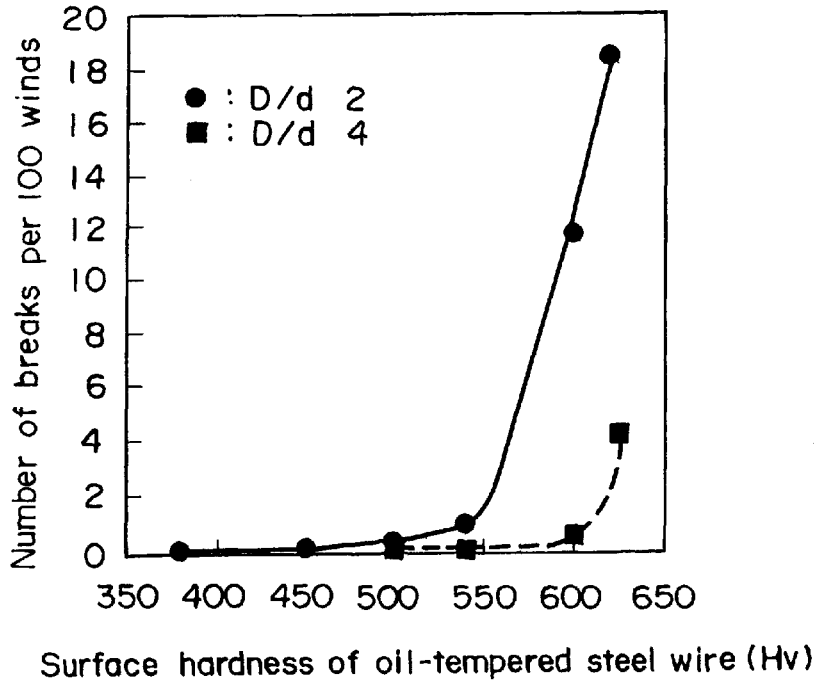
FIG. 7 is a graph showing how the result of a coiling test (number of breaks per 100 winds) varied as a function of the value of the difference between the internal hardness and the surface hardness of the oil-tempered steel wire.

FIG. 7 shows how the results of the coiling test varied with the oil-tempered steel wire surface hardness. The results are expressed in terms of number of breaks per 100 winds. When D/d was 2, almost no breaks occurred when the difference between the surface hardness and the internal hardness at a depth of greater than 200 $\mu$m from the wire surface (i.e., internal hardness minus surface hardness) was 50 or greater (Hv). When D/d was 4, almost no breaks occurred when the difference between the surface hardness and the internal hardness at a depth of greater than 200 $\mu$m from the wire surface (i.e., internal hardness minus surface hardness) was 25 or greater (Hv).

Figure 8:
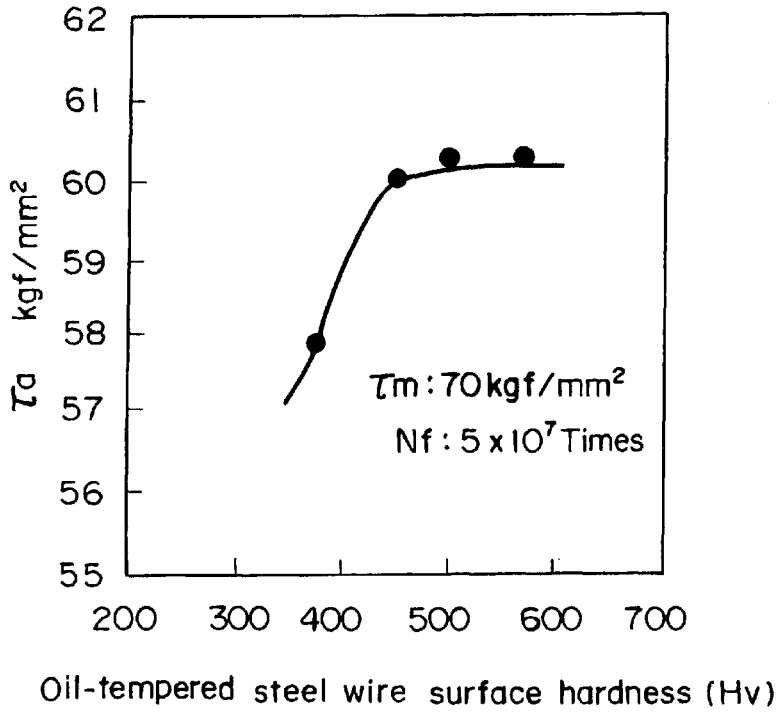
FIG. 8 is a graph showing how fatigue strength varied as a function of the surface hardness of oil-tempered steel wires used to manufacture springs.

On the other hand, materials with reduced surface hardness exhibit low fatigue strength. Springs manufactured with Comparative Materials J and K and Invention Materials L and M were therefore examined for fatigue strength. After fabrication, the springs were subjected to nitriding and/or hard shot peening treatment FIG. 8 shows how fatigue strength varied as a function of the surface hardness of the oil-tempered steel wires used to manufacture the springs. Fatigue strength degradation arose when the surface hardness (Hv) was below 420.

Figure 9:
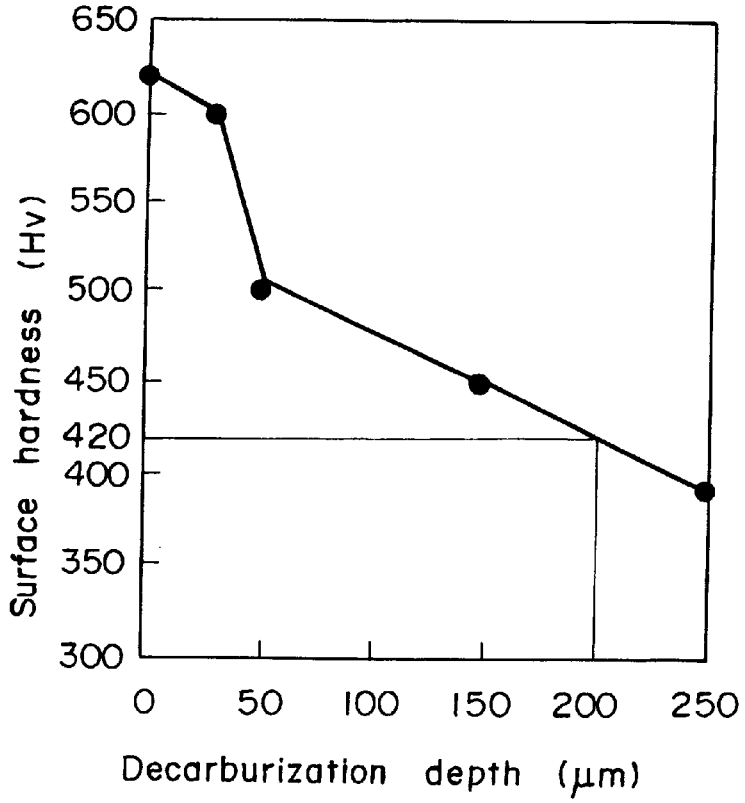
FIG. 9 is a graph showing how the surface hardness of oil-tempered steel wires used to manufacture springs varied as a function of decarburization depth.

FIG. 9 shows how the surface hardness of the oil-tempered steel wires varied as a function of decarburization depth. The decarburization depth increased with decreasing hardness of the wire surface and the decarburization depth was 200 $\mu$m when the surface hardness (Hv) was 420. Based on these results, this invention, in consideration of spring fabrication property and fatigue strength, decarburized the wire surface to a depth of not greater than 200 $\mu$m from the oil-tempered steel wire surface and in this case defines the wire surface hardness as falling between an Hv of 420 and an Hv that is 50 below the Hv of the wire interior.

Example 4

The low-alloy steel wire material shown as Test Material No. 3 in Table 1 was drawn to a wire diameter of 3.4 mm and the drawn wire was oil-tempered under different decarburizing atmosphere conditions using the continuous heating furnace 1 to obtain oil-tempered steel wires as Invention Materials N and O and Comparative Material P.

Table 5 shows the decarburizing atmosphere conditions and the property values for the materials.

TABLE 5

Decarburizing atmosphere conditions and oil-tempered steel wire properties

| | Invention Material N | Invention Material O | Comparative Material P |
|---|---|---|---|
| Test material | No. 3 | No. 3 | No. 3 |
| Inert gas | Ar | Ar | Ar |
| Inert gas feed rate (l/min) | 6 | 6 | 6 |
| Inert gas introduction point | (1) | (1) | (1) |
| Decarburizing gas | $H_2 + N_2$ + Air | $H_2 + N_2$ + Air | $H_2 + N_2$ + Air |
| $H_2 + N_2$ feed rate (l/min) | 2 | 2 | 2 |
| Air feed rate (l/min) | 0.25 | 0.25 | 0.25 |
| Decarburizing gas introduction point | (4) | (4) | (2) |
| Dew point (° C.) | +21 | +15 | +13 |
| Oil-tempered steel wire surface hardness (Hv) | 455 | 460 | 450 |
| Oil-tempered steel wire internal hardness (Hv) | 630 | 550 | 500 |
| Difference between internal hardness and surface hardness of oil-tempered steel wire (Hv) | 175 | 90 | 50 |

TABLE 5-continued

Decarburizing atmosphere conditions and oil-tempered steel wire properties

| | Invention Material N | Invention Material O | Comparative Material P |
|---|---|---|---|
| Tensile strength (kgf/mm$^2$) | 232 | 190 | 171 |
| Reduction of area (%) | 40 | 46 | 50 |
| Amount of residual austenite (%) | 10 | 7 | 3 |

Invention Materials N and O and Comparative Material P are oil-tempered steel wires whose internal hardnesses were changed by changing the tempering temperature.

Figure 10:
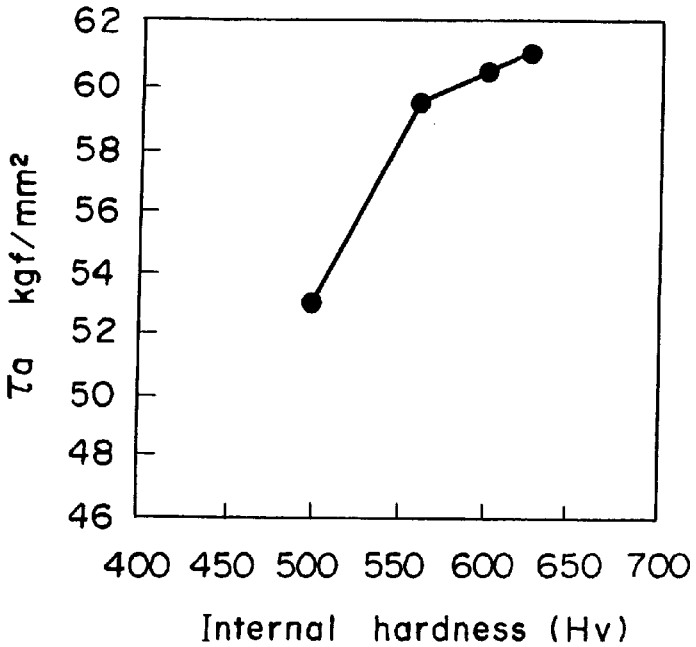
FIG. 10 is a graph showing how the fatigue strength of oil-tempered steel wires used to manufacture springs varied as a function of internal hardness.

FIG. 10 shows how fatigue strength varied with internal hardness. Fatigue strength degradation arose when the internal hardness (Hv) was below 550.

In light of this, the invention defines the hardness (Hv) at the interior of the wire beyond the depth of the decarburized layer as not less than 550.

Example 5

The low-alloy steel wire material shown as Test Material No. 2 in Table 1 was drawn to awire diameter of 3.4 mm and the drawn wire was oil-tempered under different decarburizing atmosphere conditions using the continuous heating furnace 1 to obtain oil-tempered steel wires as Invention Materials Q, R and S.

Table 6 shows the decarburizing atmosphere conditions and the property values for the materials.

TABLE 6

Decarburizing atmosphere conditions and oil-tempered steel wire properties

| | Invention Material Q | Invention Material R | Invention Material S |
|---|---|---|---|
| Test material | No. 2 | No. 2 | No. 2 |
| Inert gas | Ar | Ar | Ar |
| Inert gas feed rate (l/min) | 6 | 6 | 6 |
| Inert gas introduction point | (1) | (1) | (1) |
| Decarburizing gas | $H_2 + N_2$ + Air | $H_2 + N_2$ + Air | $H_2 + N_2$ + Air |
| $H_2 + N_2$ feed rate (l/min) | 2 | 2 | 2 |
| Air feed rate (l/min) | 0.70 | 0.70 | 0.70 |
| Decarburizing gas introduction point | (2) | (3) | (4) |
| Dew point (° C.) | +20 | +20 | +20 |
| Oil-tempered steel wire surface hardness (Hv) | 450 | 510 | 560 |
| Oil-tempered steel wire internal hardness (Hv) | 625 | 625 | 625 |
| Difference between internal hardness and surface hardness of oil-tempered steel wire (Hv) | 175 | 115 | 65 |
| Tensile strength (kgf/mm$^2$) | 232 | 233 | 233 |
| Reduction of area (%) | 43 | 44 | 42 |
| Amount of residual austenite (%) | 10 | 10 | 10 |

Figure 11:
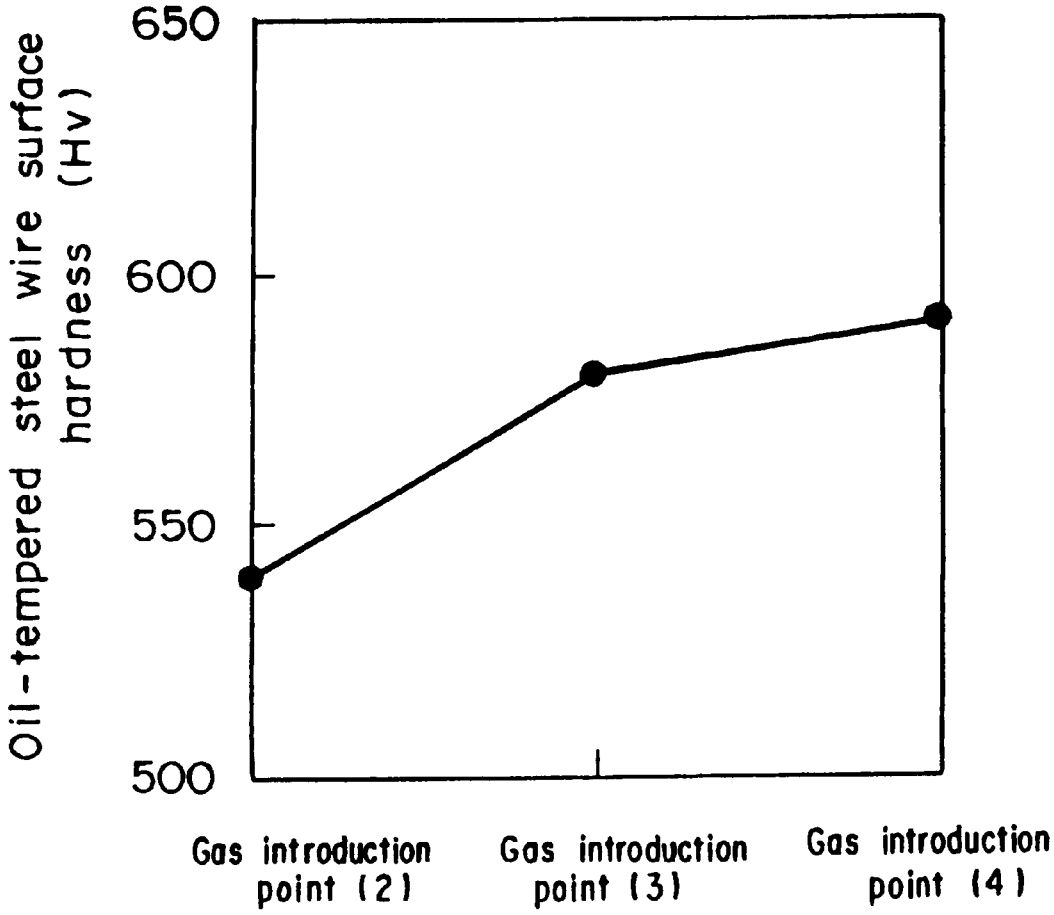
FIG. 11 is a graph showing how oil-tempered low-alloy steel wire surface hardness varied as a function of the point at which an $H_2$+$N_2$ mixed gas and air were introduced into the oil-tempered steel wire treatment pipe 2.

The surface hardnesses of Invention Materials Q, R and S were examined. The results are shown in FIG. 11.

In this Example, the introduction point at which the $H_2$+$N_2$ gas and air for generating steam was introduce was changed among (2), (3) and (4).

From the results of this &ample, it was ascertained that the surface hardness of the oil-tempered steel wire can be controlled by valuing the point at which the $H_2$+$N_2$ mixed gas and air are introduced.

Table 7 shows specifications and nitriding conditions of the springs used in the fatigue tests whose results are shown in FIGS. 8 and 10.

TABLE 7

Specification of Test Springs

| | |
|---|---|
| Wire diameter | 3.4 mm |
| Coil mean diameter | 19.4 mm |
| Effective no. of winds | 4.76 mm |
| Total no. of winds | 6.76 mm |
| Free height | 44.6 mm |
| Spring constant | 97 kgf/mm |
| **Nitriding Conditions** | |
| Nitriding temperature | 500° C. |
| Nitriding period | 120 min |

The high-strength oil-tempered steel wire of this invention exhibits excellent spring fabrication property enabling stable spring fabrication with no breakage during fabrication, even when minute surface defects that do not become fatigue starting points during use are present.

Further, springs manufactured using the invention oil-tempered steel wire can be imparted with high fatigue strength by nitriding and/or hard shot peening treatment.

Moreover, the production method of the invention enables manufacture of oil-tempered steel wire with outstanding fabrication property and uniform excellent quality.

What is claimed is:

1. A high-strength oil-tempered steel wire with excellent spring fabrication property that is made of spring low-allay steel, has a decarburized layer of reduced hardness extending to a depth of not greater than 200 $\mu$m from the wire surface, has a wire surface hardness in the range from an Hv (Vickers hardness) of 420 to an Hv of 50 below the Hv of the wire interior, and has an Hv at the interior of the wire beyond the depth of the decarburized layer of not less than 550.

2. A high-strength oil-tempered steel wire with excellent spring fabrication property according to claim 1, wherein the low-alloy steel wire comprises, in weight percent, 0.45–0.80% C, 1.2–2.5% Si, 0.5–1.5% Mn, 0.5–2.0% Cr and the balance of Fe and unavoidable impurities.

3. A high-strength oil-tempered steel wire with excellent spring fabrication properly according to claim 2, wherein the low-alloy steel wire further comprises, in weight percent, one or more of 0.1–0.7% Mo, 0.2–2.0% Ni, 0.05–0.60% V and 0.01–0.20% Nb.

4. A method for producing a high-strength oil-tempered steel wire with excellent spring fabrication property set out in any of claims 1–3, the method comprising the steps of continuously passing and heating a starting material low-alloy steel wire fed through a furnace body through-pipe of a continuous heating furnace for oil tempering, decarburizing the low-alloy steel wire under regulation of a dew point of a decarburizing atmosphere in the pipe by introducing into the pipe from its inlet side or a desired intermediate point thereof hydrogen gas or a mixed gas of hydrogen gas and an inert gas and, to form steam by reaction therewith, oxygen gas or an oxygen-containing gas and controlling the amount of oxygen gas or oxygen-containing gas introduced, and thereafter quenching and annealing the low-alloy steel wire.

5. A method for producing a high-strength oil-tempered steel wire with excellent spring fabrication property according to claim 4, wherein an inert gas is further introduced into the pipe from a point more toward the upstream side of the furnace than the point of the pipe where the hydrogen gas or the mixed gas of hydrogen gas and inert gas and the oxygen gas or oxygen-containing gas are introduced, thereby stabilizing the decarburizing atmosphere by continuously pushing the steam atmosphere generated in the pipe toward the downstream side of the heating furnace.

6. A method for producing a high-strength oil-tempered steel wire with excellent spring fabrication property set out in any of claims 1–3, the method comprising the steps of continuously passing and heating a starting material low-alloy steel wire fed through a furnace body through-pipe of a continuous heating furnace for oil tempering, decarburizing the low-alloy steel wire under regulation of a dew point of a decarburizing atmosphere in the pipe by introducing into the pipe from its inlet side or a desired intermediate point thereof hydrogen gas or a mixed gas of hydrogen gas and an inert gas and, to form steam by reaction therewith, oxygen gas or an oxygen-containing gas, introducing an inert gas into the pipe from a point more toward the upstream side of the furnace than the point of the pipe where said gases are introduced, and controlling the amount of inert gas introduced, and thereafter quenching and annealing the low-alloy steel wire.

7. A method for producing a high-strength oil-tempered steel wire with excellent spring fabrication properly according to any of claim 4, wherein the hardness of the low-alloy steel wire surface is regulated by changing the point of the pipe where the hydrogen gas or the mixed gas of hydrogen gas and inert gas and the oxygen gas or oxygen-containing gas are introduced, so as to change the duration of the exposure of the low-alloy steel wire under treatment to the decarburizing atmosphere.

8. A method for producing a high-strength oil-tempered steel wire with excellent spring fabrication property according to claim 5, wherein the hardness of the low-alloy steel wire surface is regulated by changing the point of the pipe where the hydrogen gas or the mixed gas of hydrogen gas and inert gas and the oxygen gas or oxygen-containing gas are introduced, so as to change the duration of the exposure of the low-alloy steel wire under treatment to the decarburizing atmosphere.

9. A method for producing a high-strength oil-tempered steel wire with excellent spring fabrication property according to claim 6, wherein the hardness of the low-alloy steel wire surface is regulated by changing the point of the pipe where the hydrogen gas or the mixed gas of hydrogen gas and inert gas and the oxygen gas or oxygen-containing gas are introduced, so as to change the duration of the exposure of the low-alloy steel wire under treatment to the decarburizing atmosphere.

* * * * *